US009007162B2

(12) United States Patent
Wilkinson et al.

(10) Patent No.: US 9,007,162 B2
(45) Date of Patent: Apr. 14, 2015

(54) LAMINATED "Y"-CORE TRANSFORMER

(71) Applicant: Hamilton Sundstrand Corporation, Windsor Locks, CT (US)

(72) Inventors: Scott P. Wilkinson, German Valley, IL (US); James H. Clemmons, Freeport, IL (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 13/628,797

(22) Filed: Sep. 27, 2012

(65) Prior Publication Data

US 2014/0085029 A1 Mar. 27, 2014

(51) Int. Cl.

| | |
|---|---|
| ***H01F 27/26*** | (2006.01) |
| ***H01F 27/28*** | (2006.01) |
| ***H01F 30/12*** | (2006.01) |
| ***H01F 27/24*** | (2006.01) |
| ***H01F 27/245*** | (2006.01) |

(52) U.S. Cl.

CPC ..... *H01F 30/12* (2013.01); *H01F 27/2455* (2013.01); *H01F 27/263* (2013.01)

(58) Field of Classification Search

CPC ..... H01F 3/00; H01F 3/02; H01F 3/04; H01F 27/24; H01F 27/245; H01F 27/25; H01F 27/26; H01F 27/263; H01F 27/266; H01F 30/12; H01F 41/0213; H01F 41/0226; H01F 41/0233

USPC ..... 336/170, 5, 145, 178, 210, 212, 216, 336/184, 214, 215; 33/170, 5, 145, 178, 33/210, 212, 216, 184; 29/602.1

See application file for complete search history.

(56) References Cited

U.S. PATENT DOCUMENTS

| | | | | | |
|---|---|---|---|---|---|
| 2,456,459 | A | * | 12/1948 | Somerville | 336/215 |
| 2,486,220 | A | * | 10/1949 | Somerville | 336/217 |
| 2,522,244 | A | * | 9/1950 | Vienneau | 336/210 |
| 2,594,001 | A | * | 4/1952 | Ellis et al. | 336/215 |
| 2,594,002 | A | * | 4/1952 | Ellis et al. | 336/215 |
| 2,899,656 | A | * | 8/1959 | Smith | 336/211 |
| 2,974,402 | A | * | 3/1961 | Hurt, Jr. | 29/605 |
| 3,195,081 | A | * | 7/1965 | Kunes | 336/5 |
| 3,195,090 | A | * | 7/1965 | Burkhardt et al. | 336/218 |
| 3,206,835 | A | | 9/1965 | Zwelling | |
| 3,287,682 | A | | 11/1966 | Holcomb | |
| 3,428,930 | A | * | 2/1969 | Sliepenbeek | 336/212 |
| 3,428,931 | A | * | 2/1969 | Sliepenbeek | 336/212 |
| 3,453,576 | A | * | 7/1969 | Sliepenbeek | 336/212 |

(Continued)

FOREIGN PATENT DOCUMENTS

| | | | |
|---|---|---|---|
| CH | 466421 | A | 12/1968 |

OTHER PUBLICATIONS

Extended European Search Report from EP Application Serial No. 13184540.6, dated Nov. 5, 2014, 7 pages.

*Primary Examiner* — Mangtin Lian
(74) *Attorney, Agent, or Firm* — Kinney & Lange, P.A.

(57) ABSTRACT

A "Y"-shaped transformer includes a "Y" shaped magnetic core that includes a top portion and a bottom portion. The top portion and the bottom portion both include a plurality of "Y"-shaped laminates stacked on top of one another and bent to form a plurality of core limbs. A plurality of input windings are wound around each of the plurality of core limbs. A plurality of output windings wound are wound around each of the plurality of core limbs.

10 Claims, 6 Drawing Sheets

(56) References Cited

U.S. PATENT DOCUMENTS 4,134,044 A * 1/1979 Holmes ..... 315/209 R
4,557,039 A * 12/1985 Manderson ..... 29/605
4,876,634 A 10/1989 Paice
2006/0001516 A1 * 1/2006 Mazur et al. ..... 336/5

* cited by examiner

LAMINATED "Y"-CORE TRANSFORMER

BACKGROUND

The present invention is related to transformers, and in particular to the geometry and construction of transformers.

Transformers are used in a variety of applications to step-up and/or step down voltages, while providing galvanic isolation between an input and an output. In a multi-phase transformer, windings associated with each phase are wrapped around separate legs of a magnetic core. Impedance variations between the plurality of legs results in phase imbalances that negatively affect transformer performance.

SUMMARY

A "Y"-shaped transformer includes a "Y" shaped magnetic core that includes a top portion and a bottom portion. The top portion and the bottom portion both include a plurality of "Y"-shaped laminates stacked on top of one another and bent to form a plurality of core limbs. A plurality of input windings are wound around each of the plurality of core limbs. A plurality of output windings are wound around each of the plurality of core limbs.

DETAILED DESCRIPTION

Figure 1:
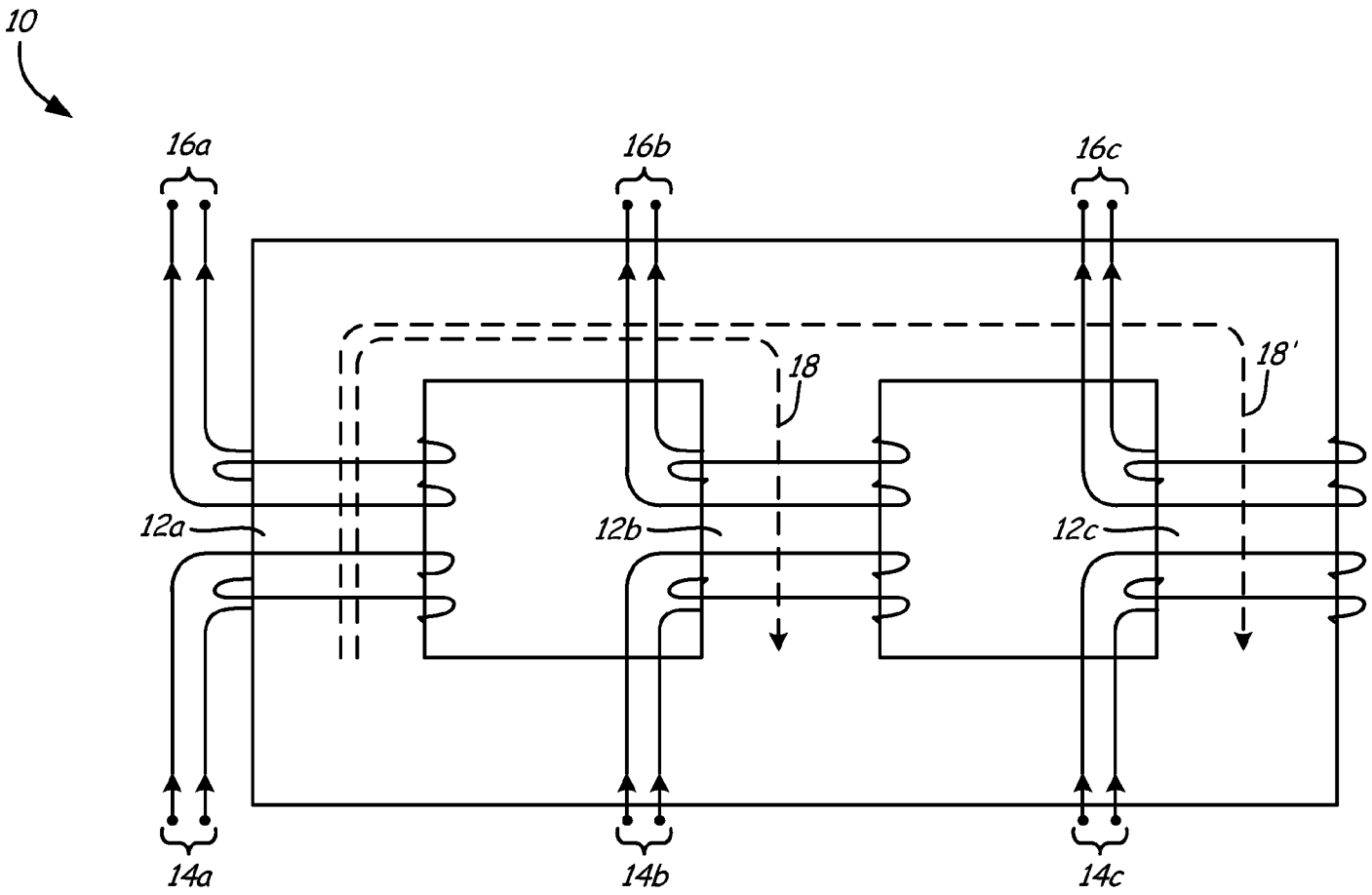
Fig. 1 (Prior Art)
FIG. 1 is a side view of a traditional "E/I"-shaped magnetic core transformer as known in the prior art.

FIG. 1 is a side view of "E/I"-shaped magnetic core transformer 10 as known in the prior art. In this type of configuration, transformer 10 includes three separate core limbs 12*a*, 12*b*, and 12*c*, each connected to one another. A plurality of input windings 14*a*, 14*b*, and 14*c* are wound around core limbs 12*a*, 12*b*, and 12*c*, respectively. Likewise, a plurality of output windings 16*a*, 16*b*, and 16*c* are wound around core limbs 12*a*, 12*b*, and 12*c*, respectively. Magnetic flux generated in core limb 12*a* is communicated to core limb 12*b*, via magnetic flux path 18, and to core limb 12*c* via magnetic flux path 18'. A consequence of the "E/I" geometry is that magnetic flux path 18 is shorter than magnetic flux path 18'. As a result, the impedance associated with magnetic flux path 18 is less than the impedance associated with magnetic flux path 18'. This difference in impedance generates imbalances in the phase outputs 16*a*, 16*b*, and 16*c*.

Figure 2:
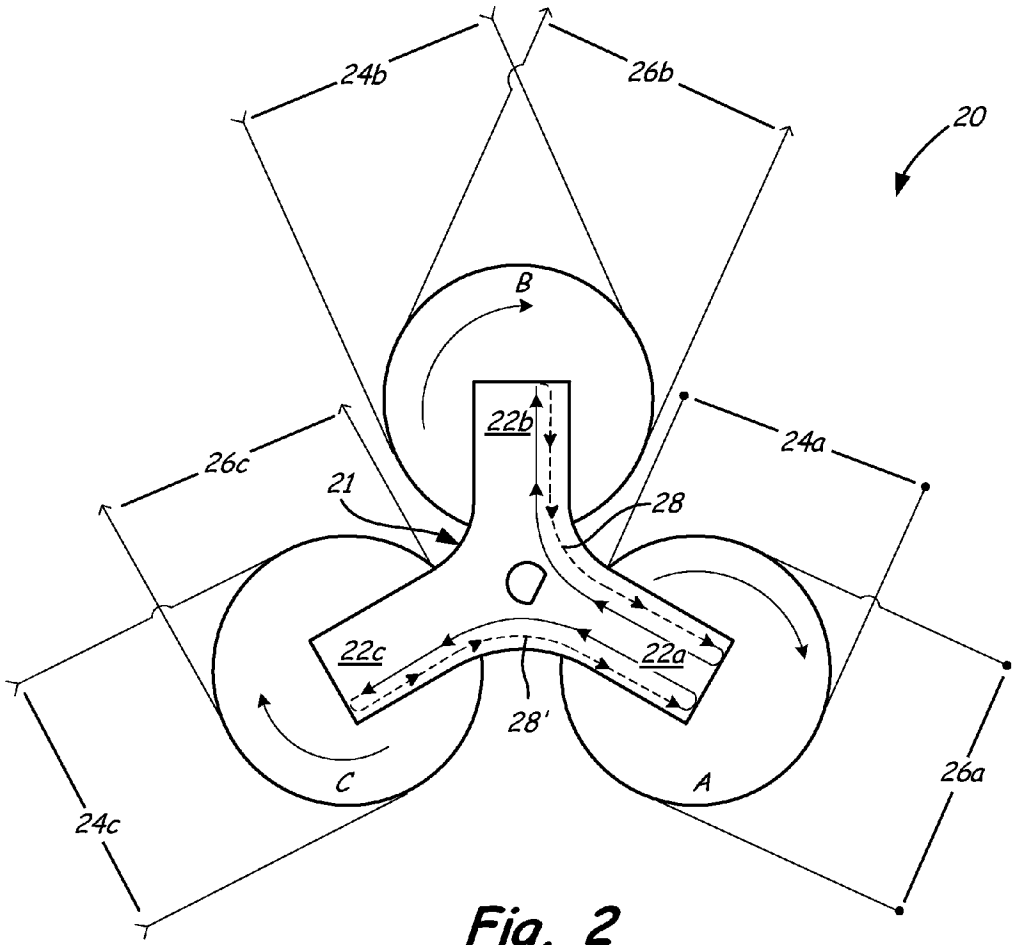
FIG. 2 is a top view of a "Y"-shaped magnetic core transformer according to an embodiment of the present invention.

FIG. 2 is a top view of "Y"-shaped magnetic core transformer 20 according to an embodiment of the present invention. Transformer 20 includes "Y"-shaped magnetic core 21, which includes three core limbs 22*a*, 22*b*, and 22*c*, each connected to one another in a "Y" configuration. A plurality of input windings 24*a*, 24*b*, and 24*c* and a plurality of output windings 26*a*, 26*b*, and 26*c* are wrapped around each core limb 22*a*, 22*b*, and 22*c*, respectively. Magnetic flux generated in core limb 22*a* is communicated to both core limb 22*b* via magnetic flux path 28 and to core limb 22*c* via magnetic flux path 28'. However, in contrast with the "E/I"-shaped geometry illustrated in FIG. 1, the length of magnetic flux paths 28 and 28' in the "Y"-shaped geometry are equal to one another. Furthermore, magnetic flux paths between the other phases (e.g., between phase C and B) would similarly have a length equal to magnetic flux paths 28 and 28'. With this configuration, there is no substantial difference in the length of magnetic flux paths between respective core limbs, and therefore no substantial difference in impedance between each of the plurality of core limbs.

Figure 3:
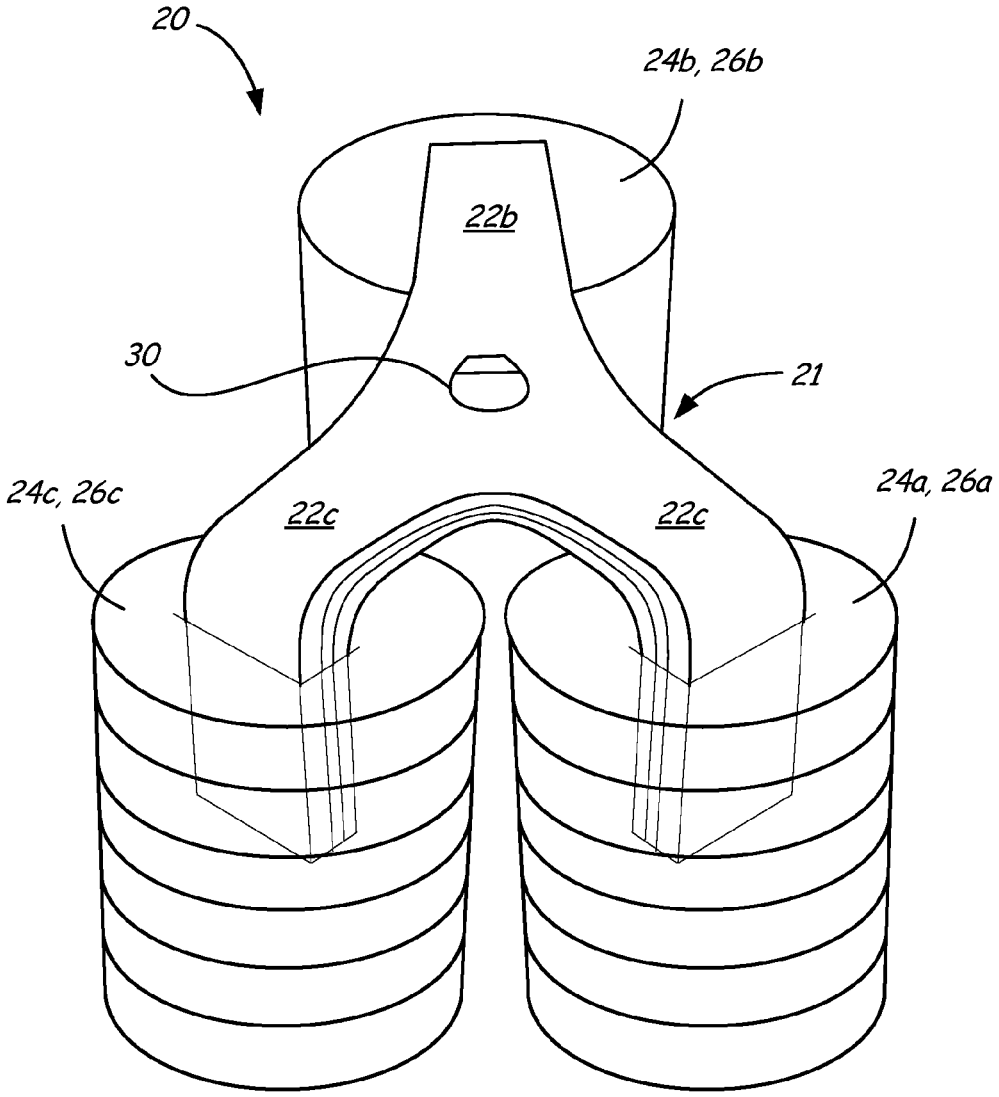
FIG. 3 is an isometric view of a multi-phase transformer having a 'Y'-shaped magnetic core according to an embodiment of the present invention.

FIG. 3 is an isometric view of transformer 20 having 'Y'-shaped magnetic core 21 according to an embodiment of the present invention. As discussed with respect to FIG. 2, transformer 20 includes "Y"-shaped magnetic core 21, which includes three core limbs 22*a*, 22*b*, and 22*c*, each connected to one another in a "Y" configuration. Each core limb 22*a*-22*c* extends in a radially outward from key mechanism 30, which is located in a center portion of magnetic core 21. Key mechanism 30 has an irregular shape that ensures all laminates (shown in FIGS. 4 and 5) are aligned properly during assembly. In addition, the radially outward portion of each core limb 22*a*, 22*b*, and 22*c* turns downward (as shown in FIG. 4) and provides a leg around which input and output coils are wound.

Figure 5:
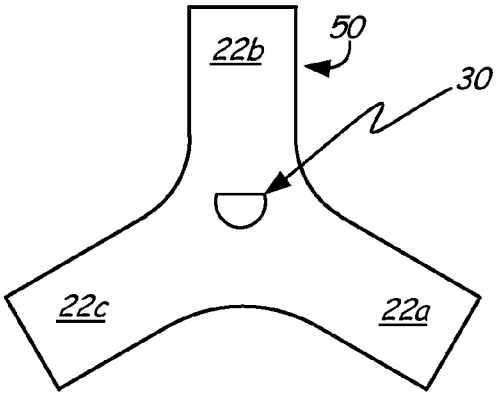
FIG. 5 is an exploded view of a top half and bottom half of the Y-shaped magnetic core according to an embodiment of the present invention.
Figure 4:
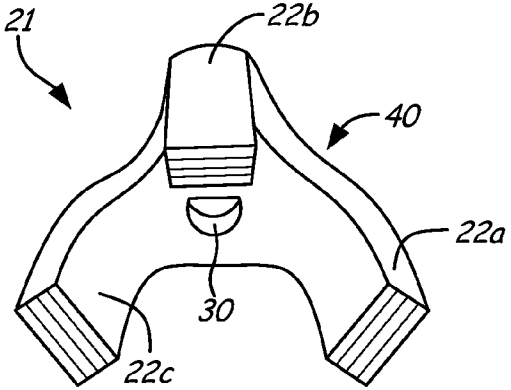
FIG. 4 is a top view of a single lamination employed in the Y-shaped magnetic core according to an embodiment of the present invention.
Figure 4:
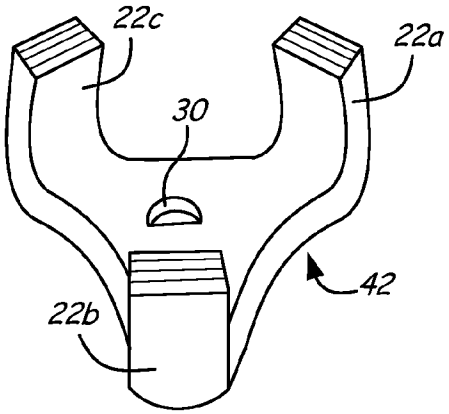

FIG. 4 is an exploded view of magnetic core 21 according to an embodiment of the present invention. In the embodiment shown in FIG. 4, magnetic core 21 includes top portion 40 and bottom portion 42. Both top portion 40 and bottom portion 42 are identical and interchangeable with one another, and may be constructed using the same manufacturing process. Both top portion 40 and bottom portion 42 are constructed of a plurality of laminates, an example of which is shown in FIG. 5, and which are visible at the end of each core limb 22*a*, 22*b*, 22*c*, 22*a*', 22*b*', and 22*c*'. To ensure communication of magnetic flux from, for example, core limb 22*a* to core limb 22*a*', the laminates associated with each core limb must be aligned properly. To this end, key mechanism 30 is used to ensure correct position of each laminate during the manufacturing and assembly process, such that when top portion 40 and bottom portion 42 are brought together, laminates associated with each are aligned.

FIG. 5 is a top view of single lamination 50 employed in Y-shaped magnetic core 21 according to an embodiment of the present invention. In the embodiment shown in FIG. 5, laminate 50 has been punched out or otherwise formed to create the desired "Y"-shaped geometry. In addition, keyhole mechanism 30 is also punched out or formed in laminate 50. A benefit of the present invention is the utilization of two-dimensional laminates which are easier to manufacture than three-dimensional shapes.

To form top portion 40 or bottom portion 42, a plurality of laminates 50 are stacked on top of one another to form a cylinder of "Y"-shaped laminates. Each core limb 22*a*, 22*b*, and 22*c*, is then bent to form the desired core limb geometry. Keyhole mechanism 30 may once again be utilized to maintain an exact position of laminates 50 during the stacking and bending process. In particular, key mechanism 30 ensures that each laminate 50 is held in the same position, and ensures that during the bending process all core limbs 22*a*, 22*b*, and 22*c* are bent at the same location. Bending the plurality of laminates results in varying lengths at the end of each core limb. To provide a smooth end surface between core limbs associated with top portion 40 and bottom portion 42, the ends of each core limb 22*a*, 22*b*, and 22*c* are cut to form a flat surface.

Figure 6:
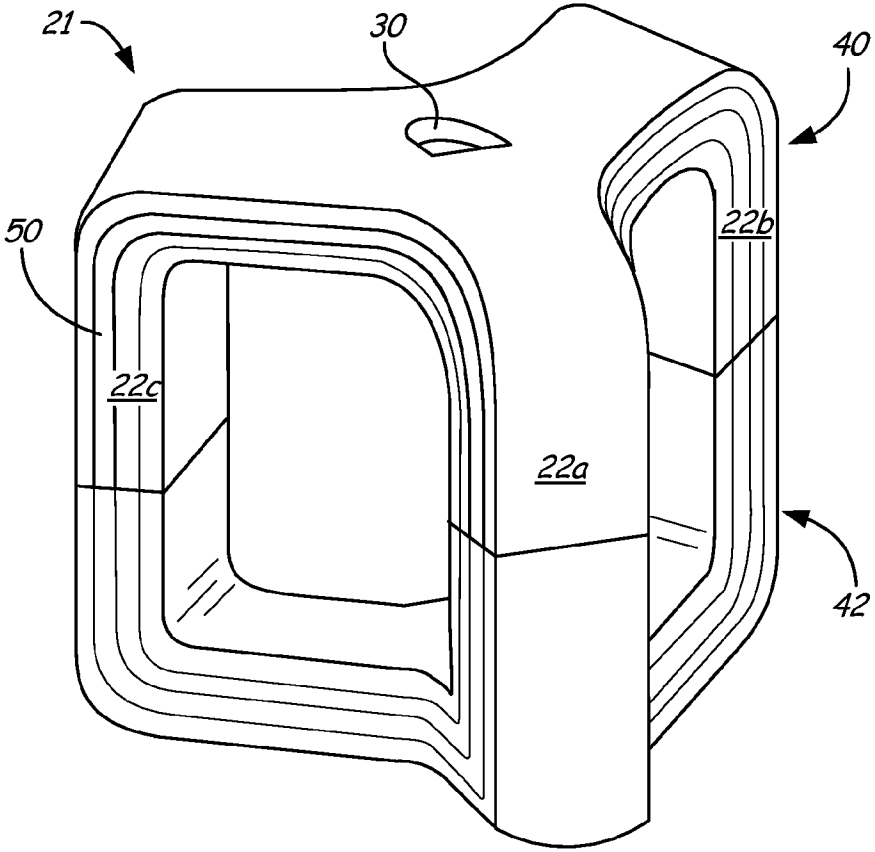
FIG. 6 is an isometric view of the Y-shaped magnetic core as assembled according to an embodiment of the present invention.

FIG. 6 is an isometric view of Y-shaped magnetic core 21 as assembled according to an embodiment of the present invention. In the embodiment shown in FIG. 6, the plurality of laminates 50 making up top portion 40 and bottom portion 42 are illustrated. In particular, each laminate 50 in top portion 40 is lined up with a counterpart laminate in bottom portion 42. It is important that laminates are aligned between top portion 40 and bottom portion 42. Key mechanism 30 during the stacking and bending process ensures both top portion 40 and bottom portion 42 are identical, and will therefore align properly when stacked as shown in FIG. 6.

Figure 7:
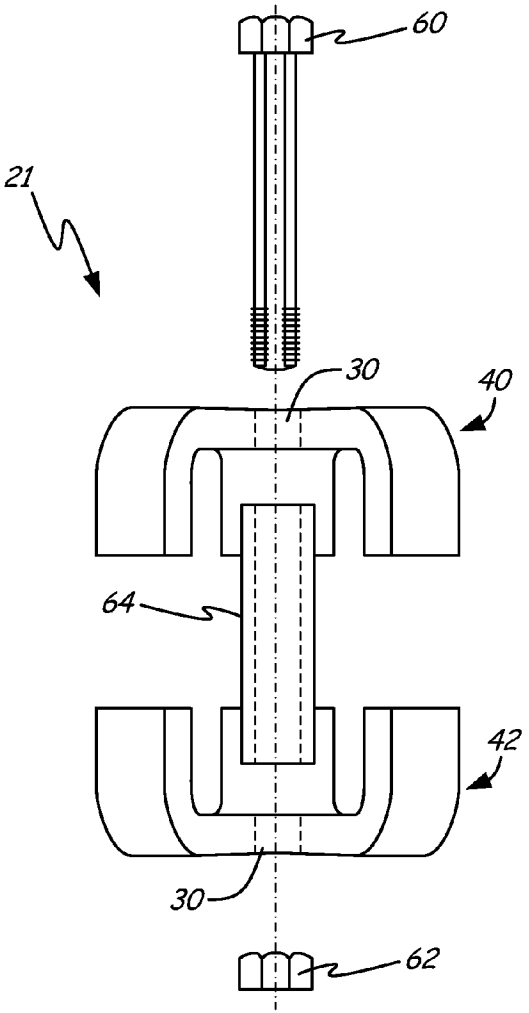
FIG. 7 is a cross-sectional view of the Y-shaped magnetic core according to an embodiment of the present invention.

FIG. 7 is a cross-sectional view of Y-shaped magnetic core 21 according to an embodiment of the present invention. In the embodiment shown in FIG. 7, top portion 40 and bottom portion 42 are secured to one another by bolt 60 and nut 62. In particular, bolt 60 is inserted through key mechanism 30 located in both top portion 40 and bottom portion 42, and secured by nut 62. In one embodiment, bolt 60 is inserted through spacer 64 before being secured by nut 62. Spacer 64 provides a gap between top portion 40 and bottom portion 42 that is dictated by the length of spacer 64.

The invention claimed is:

1. A transformer comprising:

a "Y"-shaped magnetic core that includes a top portion and a bottom portion, wherein the top portion and the bottom portion both include a plurality of "Y"-shaped laminates stacked on top of one another and bent to form a plurality of core limbs arranged so that each of the core limbs of the top portion extend in a downward direction and each of the core limbs of the bottom portion extend in an upward direction to abut the core limbs of the top portion;

an input winding wound around each of the plurality of core limbs; and an output winding wound around each of the plurality of core limbs;

wherein the top portion and the bottom portion each include a key mechanism formed in a center portion of each of the plurality of laminates, the key mechanism comprising a rotationally asymmetric irregular shape configured to align the plurality of core limbs.

2. The transformer of claim 1, wherein the top portion and the bottom portion are oriented such that each of the plurality of core limbs in the top portion is aligned with a corresponding one of the plurality of core limbs in the bottom portion, and an end surface of each core limb in the top portion abuts an end surface of the corresponding core limb in the bottom portion.

3. The transformer of claim 1, further including:

a bolt inserted through the key mechanism in both the top portion and the bottom portion of the "Y"-shaped magnetic core to maintain alignment of the top portion and the bottom portion.

4. The transformer of claim 3, further including:

a nut attached to the bolt to secure the top portion to the bottom portion.

5. The transformer of claim 4, further including:

a spacer located between the top portion and the bottom portion that maintains a desired gap between the top portion and the bottom portion when secured to one another.

6. The transformer of claim 1, wherein a magnetic flux path is created in each of created in each of the plurality of core limbs are substantially equal to one another.

7. The transformer of claim 6, wherein impedance associated with the plurality of magnetic flux paths are substantially equal.

8. A "Y"-shaped magnetic core comprising:

a first plurality of "Y"-shaped laminates stacked together to form a top portion having a plurality of core limbs defined by the "Y"-shape of the laminates, wherein each of the plurality of core limbs of the top portion extends in a downward direction, and a first rotationally asymmetric key mechanism is located in a center of the first plurality of laminates;

a second plurality of "Y"-shaped laminates stacked together to form a bottom portion having a plurality of core limbs defined by the "Y"-shape of the laminates, wherein each of the plurality of core limbs of the bottom portion extends in an upward direction, and a second rotationally asymmetric key mechanism is located in a center of the second plurality of laminates;

flat end surfaces at locations on each of the laminates where the top portion abuts the bottom portion; and a fastening mechanism that secures the top portion to the bottom portion, such that the smooth end surface of the plurality of core limbs associated with the top portion is aligned with the smooth end surface of the plurality of core limbs associated with the bottom portion.

9. The "Y"-shaped magnetic core of claim 8, wherein the first and second rotationally asymmetric key mechanisms interact with the fastening mechanism to only allow each of the plurality of laminates to be aligned with one another in the same orientation.

10. The "Y"-shaped magnetic core of claim 9, wherein the fastening mechanism that secures the top portion and the bottom portion is a bolt inserted through the first and second rotationally asymmetric key mechanism in the top portion and the bottom portion, wherein the bolt is keyed to ensure alignment between the top portion and the bottom portion.

* * * * *